US009758987B2

(12) United States Patent
McCann et al.

(10) Patent No.: US 9,758,987 B2
(45) Date of Patent: Sep. 12, 2017

(54) SELF-LEARNING LOCK AND LOCK ASSEMBLY APPARATUS

(71) Applicant: RB Distribution, Inc., Colmar, PA (US)

(72) Inventors: Marc McCann, Philadelphia, PA (US); Brandon Graver, Lansdale, PA (US); Stephen R. Ide, Nazareth, PA (US)

(73) Assignee: RB Distribution, Inc., Colmar, PA (US)

( * ) Notice: Subject to any disclaimer, the term of this patent is extended or adjusted under 35 U.S.C. 154(b) by 2 days.

(21) Appl. No.: 14/869,382

(22) Filed: Sep. 29, 2015

(65) Prior Publication Data

US 2016/0090752 A1 Mar. 31, 2016

Related U.S. Application Data

(60) Provisional application No. 62/056,918, filed on Sep. 29, 2014.

(51) Int. Cl.
*E05B 19/00* (2006.01)
*E05B 27/00* (2006.01)

(52) U.S. Cl.
CPC ..... *E05B 19/0011* (2013.01); *E05B 27/005* (2013.01); *E05B 27/0017* (2013.01)

(58) Field of Classification Search
CPC ..... E05B 27/005; E05B 27/0017; E05B 19/0011; E05B 27/00; E05B 27/04; E05B 29/00; E05B 29/04; E05B 29/06; Y10T 70/7599; Y10T 70/7469; Y10T 70/7734; Y10T 70/7616; Y10T 70/5956; Y10T 70/5664
USPC ..... 70/492, 383, 384
See application file for complete search history.

(56) References Cited

U.S. PATENT DOCUMENTS 3,589,153 A 6/1971 Hill
6,860,131 B2 * 3/2005 Armstrong ..... E05B 27/005 70/383
7,007,528 B2 3/2006 Chong et al.
7,114,357 B2 * 10/2006 Armstrong ..... E05B 27/005 70/340
7,140,213 B2 11/2006 Feucht et al.
7,213,429 B2 5/2007 Armstrong et al.
7,434,431 B2 10/2008 Armstrong et al.
7,565,825 B2 * 7/2009 Wheatland ..... E05B 27/005 70/383
7,624,606 B1 * 12/2009 Huang ..... E05B 29/004 70/338
7,628,048 B2 * 12/2009 Huang ..... E05B 29/004 70/338
7,634,930 B2 12/2009 Boesel et al.
(Continued)

*Primary Examiner* — Suzanne Barrett
(74) *Attorney, Agent, or Firm* — Volpe and Koenig, P.C.

(57) ABSTRACT

A self-learning lock cylinder assembly or lock tumbler and tools capable of teaching the self-learning key configuration of a pre-existing key is disclosed. The individual performing the self-learning does not need to have prior locksmith experience. The individual performing the self-learning procedure can verify that the original key and copies of the original key function properly within the lock cylinder prior to final assembly and installation in the lock through a self-learning test housing. The pre-installation testing eliminates problems associated with an incorrectly assembled lock cylinder.

5 Claims, 3 Drawing Sheets

(56) References Cited

U.S. PATENT DOCUMENTS 7,836,739 B2 * 11/2010 Huang ..... E05B 27/005 70/340
7,937,976 B2 * 5/2011 Huang ..... E05B 29/004 70/338
7,980,104 B1 * 7/2011 Huang ..... E05B 29/004 70/338
7,980,106 B2 * 7/2011 Huang ..... E05B 29/004 70/340
8,056,378 B2 * 11/2011 Huang ..... E05B 29/004 70/338
8,074,480 B2 * 12/2011 Huang ..... E05B 27/005 70/337
8,161,783 B2 4/2012 Huang et al.
8,347,678 B2 * 1/2013 Chong ..... E05B 27/005 70/340
8,448,484 B2 * 5/2013 Huang ..... E05B 29/004 70/340
8,739,587 B2 * 6/2014 Chen ..... E05B 27/005 70/383
8,881,567 B2 * 11/2014 Chong ..... E05B 29/004 29/804
8,893,536 B2 * 11/2014 Huang ..... E05B 27/005 70/340
2004/0163433 A1 * 8/2004 Armstrong ..... E05B 9/04 70/493
2005/0016234 A1 * 1/2005 Strader ..... E05B 9/04 70/492
2006/0059965 A1 * 3/2006 Benstead ..... E05B 27/005 70/493
2009/0277239 A1 * 11/2009 Mathachan ..... E05B 27/005 70/383
2011/0041577 A1 * 2/2011 Zhang ..... E05B 27/005 70/384
2012/0247163 A1 * 10/2012 Damikolas ..... E05B 27/001 70/492
2013/0086958 A1 * 4/2013 Emory ..... E05B 29/004 70/495

* cited by examiner

SELF-LEARNING LOCK AND LOCK ASSEMBLY APPARATUS

CROSS REFERENCE TO RELATED APPLICATION

This application claims the benefit of U.S. provisional application 62/056,918, filed Sep. 29, 2014 which is incorporated by reference as if fully set forth.

FIELD OF INVENTION

The present invention relates to lock assemblies that can be programmed to accept an existing key. Locks of this type are generally referred to as adaptable to being rekeyed.

BACKGROUND

Current lock cylinders and mating keys often wear from repeated use or may be otherwise damaged and need to be replaced. This problem is especially evident in the area of automotive ignitions. A problem arises with replacement of the lock cylinder in an automotive ignition or other similar application when the original key includes other functions such as opening doors, the trunk lid or windows. Furthermore, the original key maybe digitally coded to other automobile applications or anti-theft systems.

Current lock cylinders that can be rekeyed involve disassembly and re-assembly of internal components by a skilled user or are one-time only assemblies with no means to verify additional copies of the original key are functional after a rekeying procedure. Examples of prior attempts at solving the problems with the prior art are found in U.S. Pat. Nos. 3,589,153; 6,860,131; 7,007,528; 7,140,213; 7,213,429; 7,634,930; and 8,161,783.

There exists a need for a simplified self-learning lock assembly that enables the reuse of the original key when replacing a defective lock cylinder.

SUMMARY

The present invention provides of a lock cylinder assembly or lock tumbler and tools capable of self-learning a key's configuration so it is usable with a pre-existing key. The individual performing the self-learning does not need to have prior locksmith experience. The individual performing the self-learning procedure can verify that the original key and copies of the original key function properly within the lock cylinder prior to final assembly and installation in the lock through a self-learning test housing. The advantage of the pre-installation testing is that it eliminates the problem associated with an incorrectly assembled lock cylinder.

BRIEF DESCRIPTION OF THE DRAWING(S)

DETAILED DESCRIPTION OF THE PREFERRED EMBODIMENT(S)

Figure 2:
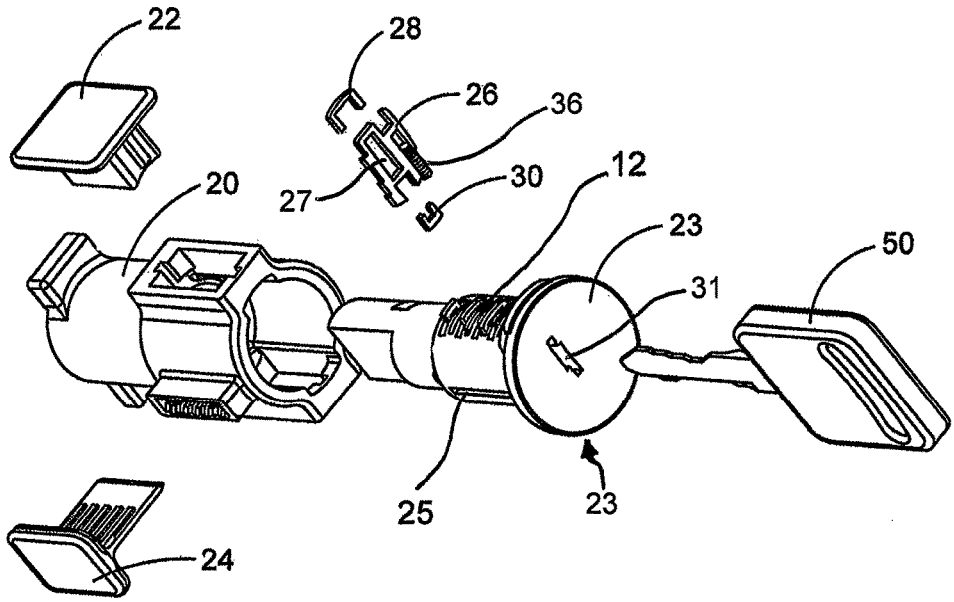
FIG. 2 is an exploded view of the parts assembled in FIG. 1.
Figure 3:
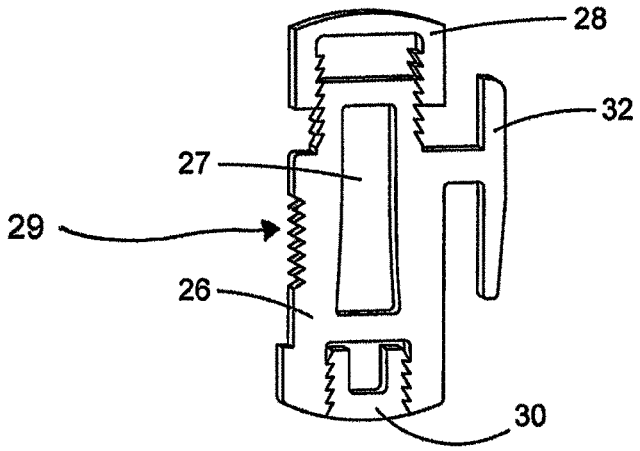
FIG. 3 illustrates a self-learning wafer.
Figure 4:
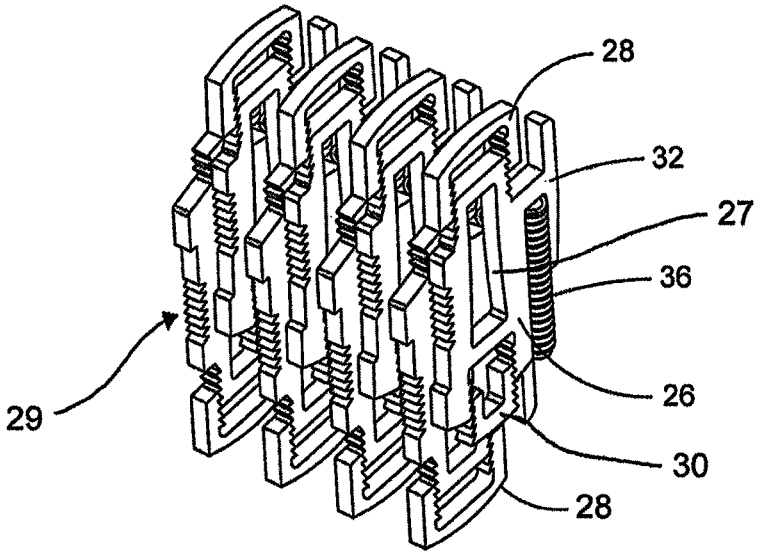
FIG. 4 illustrates and array of self-learning wafers with compression springs prior to the learning procedure.
Figure 5:
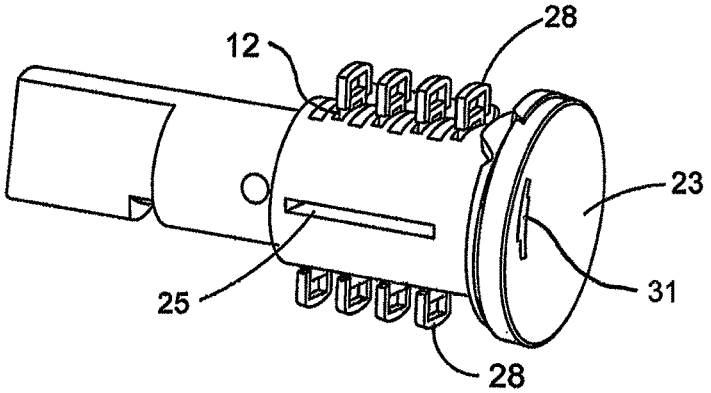
FIG. 5 illustrates one side of a self-learning plug or tumbler prior to the learning procedure.
Figure 6:
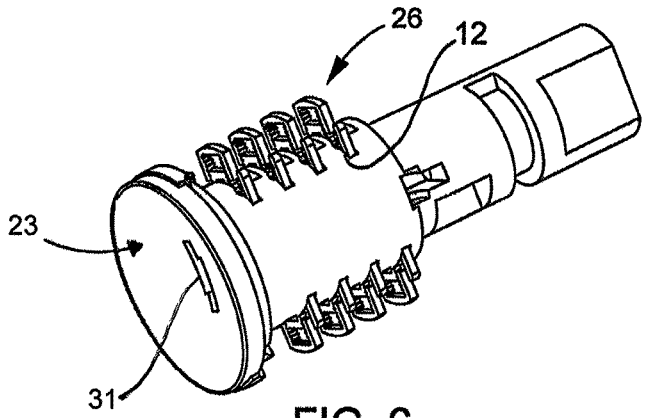
FIG. 6 illustrates the opposite side of a self-learning plug or tumbler in FIG. 5 prior to the learning procedure.

The self-learning wafer sub-assembly, FIGS. 3 and 4, enables the self-learning of the plug sub assembly 23 in FIG. 6. The wafers have a central body 26 that includes a key window or slot 27. The opposite ends of the body 26 have learning end wafers 28 and 30. On one end of body 26 there are external teeth that mate with a first learning wafer 28 and the other end of body 26 has internal teeth that mate with a second learning wafer 30. On one side of the wafer body 26 there are notches 29 that are configured to receive the wafer holding tool 24 shown in FIG. 1. The original key 50 with a preexisting topography passes through the key hole 31 in the plug or tumbler 23 and into the windows or slots 27 of the wafers shown in FIGS. 3 and 4. The compression springs 36 shown in the array of self-learning wafers in FIG. 4 abut the limiting stops 32 and bias the wafers against the coding surface or topography of the original key 50, see FIG. 2. During the learning procedure, the plug 23 is inserted in the self-learning housing 10 and the wafers are locked in place by the insertion of the wafer-holding tool 24 through the learning housing 10 and into notches 29 prior to depressing the wafer-setting tool 22. When the wafer-setting tool 22 is depressed, see FIG. 1, the wafer-setting tool sets the first group of learning wafers to the correct position to match the coding surface or associated topography of the original key 50. This procedure is repeated on the other side with the wafer-setting tool 22, to set the second group of learning wafers.

Figure 1:
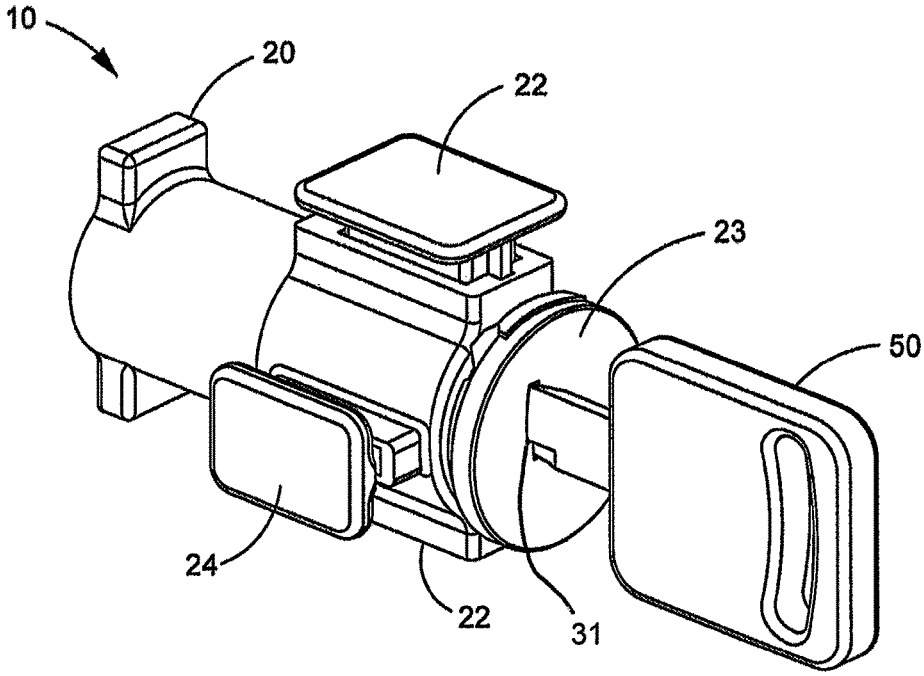
FIG. 1 illustrates an original key in a self-learning plug or tumbler during the learning procedure.

After completing the self-learning procedure with the original key still in place, the key 50 and plug assembly can be tested for operation in the self-learning housing, shown in FIGS. 1 and 2. The key and plug assembly will freely rotate from a first position to a second position. At this new second position, the wafer sub-assemblies cannot move radially out and the key 50 is locked in the plug assembly 23. The key and plug assembly will freely rotate from the second position to first position. The wafer sub-assemblies can move radially outward into receiving slots, see FIGS. 2 and 7, and the key will release from the plug sub-assembly.

If the keys do not function correctly, further adjustments can be made to the wafer sub-assemblies to obtain proper function. When the self-learning procedure is complete and verified, the key and plug sub-assembly is transferred to the housing 40 of FIG. 7, which has the external geometric features 42 to mate with an intended application, and becomes the finished assembly of FIG. 8. If desired, retesting of key function can be completed within the housing 40 to verify proper function prior to installation in the final application.

Figure 7:
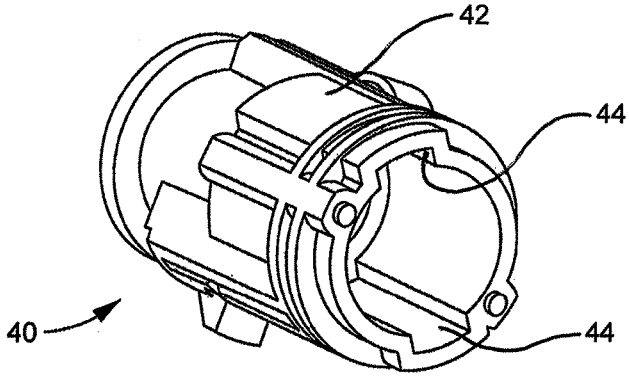
FIG. 7 illustrates a housing sub-assembly.
Figure 8:
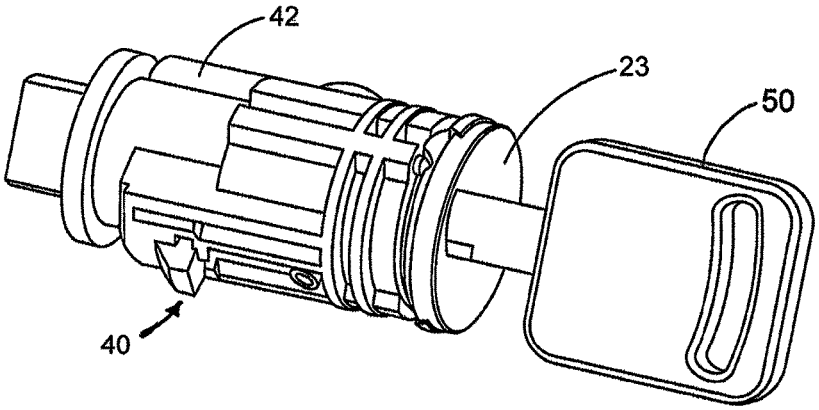
FIG. 8 illustrates the finished plug and original key after the completion of the self-learning process.

With reference to FIG. 7, the wafer receiving slots 44 in the housing 40 allow the wafer sub-assemblies to engage the housing prior to inserting the key. When a correctly learned key 50 is inserted in the plug 23, the wafer sub-assemblies move into position according to the coding surface of the key and retract from the wafer receiving slots. The plug assembly is now free to rotate within the plug 23. Once the plug assembly and key are rotated past the wafer receiving slots, the wafer sub-assemblies are restricted from movement and the key is locked in place within the plug assembly.

What is claimed is:

1. A plug assembly that self learns an existing key topography, the plug assembly comprising:

a key receiving slot that receives an existing key having a predetermined topography;

a plurality of wafer receiving slots that intersect the key receiving slot;

a plurality of wafers dimensioned to be received within the wafer receiving slot, each of the wafers is generally rectangular and has a passage that is sized and aligned to define a key passage; and, at least two movable learning segments attached to each wafer, and at least one biasing element associated with each wafer;

wherein the movable learning segments attached to each wafer are moved on the respective wafer to a position associated with the predetermined key topography.

2. A self-learning lock tumbler comprising:

a tumbler body;

a slot in the tumbler body receives an existing lock key having a predetermined topography;

a plurality of wafer receiving slots that are generally arranged perpendicular to the slot;

a plurality of wafers that are received within the wafer receiving slots, each of the plurality of wafers is generally rectangular and the plurality of wafers defines a key receiving passage; and, a plurality of movable learning segments that are mounted on each wafer of the plurality of wafers, and at least one biasing element;

wherein the movable learning segments associated with each wafer are positioned on the respective wafer according to the predetermined key topography.

3. A kit for teaching a self-learning lock tumbler comprising:

a tumbler body;

a slot in the tumbler body that receives an existing lock key having a predetermined topography;

a plurality of wafer receiving slots that are generally arranged perpendicular to the slot;

a plurality of generally rectangular wafers that are received within the wafer receiving slots, each of the plurality of wafers includes a central passage and the central passages align in a through passage that receives an existing lock key;

at least two movable learning segments attached to each wafer, and at least one biasing element associated with each wafer; and, a self-learning test housing;

whereby the movable learning segments associated with each wafer are positioned according to a predetermined key topography associated with an existing lock key and the wafer positioning accuracy is confirmed in the self-learning test housing.

4. The kit of claim 3 further comprising: a wafer-holding tool.

5. The kit of claim 4 further comprising: a wafer-setting tool.

* * * * *